US010889021B1

(12) United States Patent
Heuser, Jr.

(10) Patent No.: US 10,889,021 B1
(45) Date of Patent: Jan. 12, 2021

(54) CHAINSAW COMPRISING A SCRAPER

(71) Applicant: Josef Heuser, Jr., Pinesdale, MT (US)

(72) Inventor: Josef Heuser, Jr., Pinesdale, MT (US)

( * ) Notice: Subject to any disclaimer, the term of this patent is extended or adjusted under 35 U.S.C. 154(b) by 0 days.

(21) Appl. No.: 16/421,724

(22) Filed: May 24, 2019

(51) Int. Cl.
*B27B 17/00* (2006.01)
*B27B 17/02* (2006.01)
*B27L 1/06* (2006.01)

(52) U.S. Cl.
CPC ..... *B27B 17/0016* (2013.01); *B27B 17/02* (2013.01); *B27L 1/06* (2013.01)

(58) Field of Classification Search
CPC . B27B 17/00; B27B 17/0025; B27B 17/0083; B27B 17/02; B27B 17/0016; B27L 1/06
USPC ..... 30/371, 381–387; D8/65
See application file for complete search history.

(56) References Cited

U.S. PATENT DOCUMENTS 2,525,110 A * 10/1950 Adair ..... B27B 17/06 30/382
2,572,405 A * 10/1951 Stone et al. ..... B27B 17/0083 30/371
D168,747 S * 2/1953 Mall ..... D8/65
2,665,719 A * 1/1954 Pennanen ..... B27B 17/0083 30/371
2,777,482 A * 1/1957 Chamberlain et al. ..... B27B 17/0083 30/371
2,798,516 A * 7/1957 Heal et al. ..... B27B 17/0008 30/386
2,813,556 A * 11/1957 Woodworth ..... B27B 17/0083 30/371
2,821,213 A * 1/1958 York ..... B27B 17/0083 30/371
2,902,065 A * 9/1959 Graves et al. ..... B27B 17/0083 30/371
2,948,310 A * 8/1960 Herron ..... B27B 17/0083 30/371
D193,828 S * 10/1962 Burns ..... D8/65
3,409,056 A * 11/1968 Rauh ..... B27B 17/0033 30/381
3,612,115 A * 10/1971 Albright ..... B27B 17/02 83/796
3,680,607 A * 8/1972 Robinson ..... B27B 17/0083 30/383

(Continued)

FOREIGN PATENT DOCUMENTS

DE 202014002648 U1 * 7/2015 ..... B27B 17/0083
GB 2502648 B * 12/2014 ..... B27B 17/02

*Primary Examiner* — Jason Daniel Prone
(74) *Attorney, Agent, or Firm* — Sanchelima & Associates, P.A.; Jesus Sanchelima; Christian Sanchelima

(57) ABSTRACT

A chainsaw having a scraper used to clean or debark wood before a saw chain makes a cut is disclosed. The chainsaw includes a housing, a first casing and a second casing coupled to the housing. The first casing has a plurality of first spikes and the second casing has a plurality of second spikes. Further, the chainsaw includes a guide bar coupled to the housing. Additionally, the chainsaw includes a saw chain provided around the guide bar. The chainsaw further includes a scraper coupled to the first casing and the second casing. The scraper is aligned in axis with the saw chain. The scraper is used to clear dirt or debark on wood before the saw chain makes a cut on the wood. Thereby, protecting the teeth of the chain of the chainsaw as to extend its lifespan and require less sharpening of the teeth of the chain.

11 Claims, 6 Drawing Sheets

(56) References Cited

U.S. PATENT DOCUMENTS 3,810,309 A * 5/1974 Wiklund ..... B27B 17/0033 30/382
4,048,720 A * 9/1977 Wheeler ..... B27B 17/0083 30/372
4,123,843 A 11/1978 Bauer et al.
4,142,292 A * 3/1979 Ulrich ..... B27B 17/0083 30/371
4,211,007 A * 7/1980 Gibson ..... B27B 17/02 30/383
4,270,272 A * 6/1981 Graham ..... B27B 17/0083 30/371
4,294,012 A * 10/1981 Lanz ..... B27B 17/00 30/378
4,888,872 A * 12/1989 Eistrat ..... B27B 17/0083 30/371
4,945,641 A * 8/1990 Miller ..... B27B 17/0083 30/378
4,999,918 A * 3/1991 Schliemann ..... B27B 17/14 30/383
5,074,047 A * 12/1991 King ..... B27B 17/0083 30/382
D325,330 S * 4/1992 Barnhill ..... D8/65
5,123,168 A * 6/1992 Lyons ..... B27B 17/0083 30/382
5,249,362 A * 10/1993 Harding ..... B27B 17/02 30/381
D361,251 S * 8/1995 Griffin ..... D8/65
D365,505 S * 12/1995 Raya ..... D8/70
5,644,904 A * 7/1997 Olinger ..... A01D 34/833 30/387
5,669,145 A * 9/1997 Skripsky ..... B27B 17/0083 30/371
5,685,080 A * 11/1997 Amano ..... B27B 17/08 30/383
5,826,343 A * 10/1998 Mollberg, Jr. ..... B27B 17/0083 30/371
8,156,654 B2 * 4/2012 Reed ..... B27B 17/02 30/371
2002/0073551 A1 * 6/2002 Goodwin ..... F01M 11/0408 30/383
2005/0178010 A1 * 8/2005 Petrenko ..... B27B 17/0083 30/383
2005/0252011 A1 * 11/2005 Neumeier ..... B27B 19/09 30/371
2007/0214658 A1 * 9/2007 Payton ..... B27B 17/0083 30/371
2007/0271798 A1 * 11/2007 Webb ..... B27B 17/0083 30/371
2009/0133269 A1 * 5/2009 Hanaway ..... B27B 17/0083 30/383
2011/0203122 A1 * 8/2011 Holcomb ..... B27B 17/0083 30/382
2014/0047723 A1 * 2/2014 Vidale Wade ..... B27B 17/0083 30/383
2014/0259704 A1 * 9/2014 Clearman ..... B23D 51/02 30/514
2017/0073927 A1 * 3/2017 Blundell ..... B27B 17/08
2017/0239835 A1 * 8/2017 Ebner ..... B27B 17/02

* cited by examiner

CHAINSAW COMPRISING A SCRAPER

BACKGROUND OF THE INVENTION

1. Field of the Invention

The present invention generally relates to hand held cutting devices such as chainsaws. More specifically, the present disclosure relates to a chainsaw comprising a scraper, which is used to clean or debark wood before a saw chain makes a cut.

2. Description of the Related Art

It is known that hand held cutting devices such as chainsaws are commonly used to cut timber or wood or logs or to perform other rigorous cutting operations. Typically, gasoline engines or electric motors are used to power the chainsaws. With improvements in designs and application of the chainsaws, batteries or wired connections are used to power the chainsaws. As known, the chainsaw includes a guide bar. Around the guide bar, a saw chain is provided. The saw chain is provided with cutting teeth. The saw chain is operated at relatively high speed such that the teeth cuts wood when the teeth come in contact with wood.

Generally, the wood or logs found outdoors such as in forests or hilly areas may have rocks or dirt or mud that gets crammed in the bark of the wood. When a user uses the chainsaw to cut the wood having dirt in the bark, the saw chain may first come in contact with the dirt and that may result in the saw chain teeth becoming blunt. In order to use the saw chain for a long period of time, the user may have to sharpen the teeth of the saw chain repeatedly. Sometimes the user may have to replace the saw chain. It is known that sharpening of the teeth of the saw chain is relatively expensive and takes considerable time.

In order to overcome the above problem, several solutions have been provided in the past. One such solution includes providing spikes or claws, which allow the chainsaw to cut the wood, clear dirt and protect the saw chain. One such example is disclosed in a United States granted patent 4123843. In U.S. Pat. No. 4,123,843A, a portable power chain saw including a guide bar stop assembly that includes a claw-type stop is disclosed.

Another example is disclosed in a United States patent application 20140259704. In US20140259704A1, it is disclosed that an accessory for a reciprocating power tool includes an elongated post having a base member disposed at a distal end thereof. The base member includes an aperture. The accessory includes first and second members coupled on opposite sides of the base portion. Each of the first and second side members include a surface having a toothed portion and a non-toothed portion.

Yet another example is disclosed in United States patent application 20050252011. In US20050252011A1, it is disclosed that a guide adapter has carrier means removably secured on a tool-side end of a housing of a saber saw and a contacting element for contacting on a work piece to be worked. The contacting element has a claw contour for securing on a surface of the work piece. The carrier means has a clamping contour for immobile clamping on the housing and the claw contour is transiently affixed relative to the carrier means. The claw contour has a plurality of teeth, which are directed away from the carrier means.

Although the disclosures discussed above are useful in allowing the chainsaw to cut the wood better, they have several problems. For instance, they are limited to securing the contacting element of the chainsaw to a work piece and do not help in clearing the dirt off the bark before cutting the wood.

Other documents describing the closest subject matter provide for a number of more or less complicated features that fail to solve the problem in an efficient and economical way. None of these patents suggest the novel features of the present invention. Specifically, none of the disclosures in the art disclose a chainsaw having a mechanism to clear the dirt off the bark before cutting the wood.

Therefore, there is a need to provide a chainsaw comprising a mechanism such as a scraper, to clean or debark wood before a saw chain makes a cut.

SUMMARY OF THE INVENTION

It is one of the objects of the present invention to provide a chainsaw capable of cutting wood without damaging a saw chain and that avoids the drawbacks of the prior art.

It is another object of the present invention to provide a chainsaw comprising a scraper used to clean or debark wood before a saw chain makes a cut.

It is one object of the present invention to provide a chainsaw for cutting wood. The chainsaw comprises a housing, a first casing and a second casing coupled to the housing. The first casing comprises first spikes and the second casing comprises second spikes. Further, the chainsaw comprises a guide bar coupled to the housing. Further, the chainsaw comprises a saw chain provided around the guide bar. The chainsaw further comprises a scraper coupled to the first casing and the second casing. The scraper is aligned in axis with the saw chain. The scraper is used to clear dirt or debark on wood before the saw chain makes a cut on the wood.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

The following detailed description is intended to provide example implementations to one of ordinary skill in the art, and is not intended to limit the invention to the explicit disclosure, as one or ordinary skill in the art will understand that variations can be substituted that are within the scope of the invention as described.

The present invention disclosed is a chainsaw capable of cutting wood without damaging a saw chain. The chainsaw comprises a housing, a first casing and a second casing coupled to the housing. The first casing comprises first spikes and the second casing comprises second spikes. Further, the chainsaw comprises a guide bar coupled to the housing. Further, the chainsaw comprises a saw chain provided around the guide bar. The chainsaw further comprises a scraper coupled to the first casing and the second casing. The scraper is aligned in axis with the saw chain. The scraper is used to clear dirt on wood before the saw chain makes a cut on the wood.

Various features and embodiments of a chainsaw are explained in conjunction with the description of FIGS. 1-6.

Figure 1:
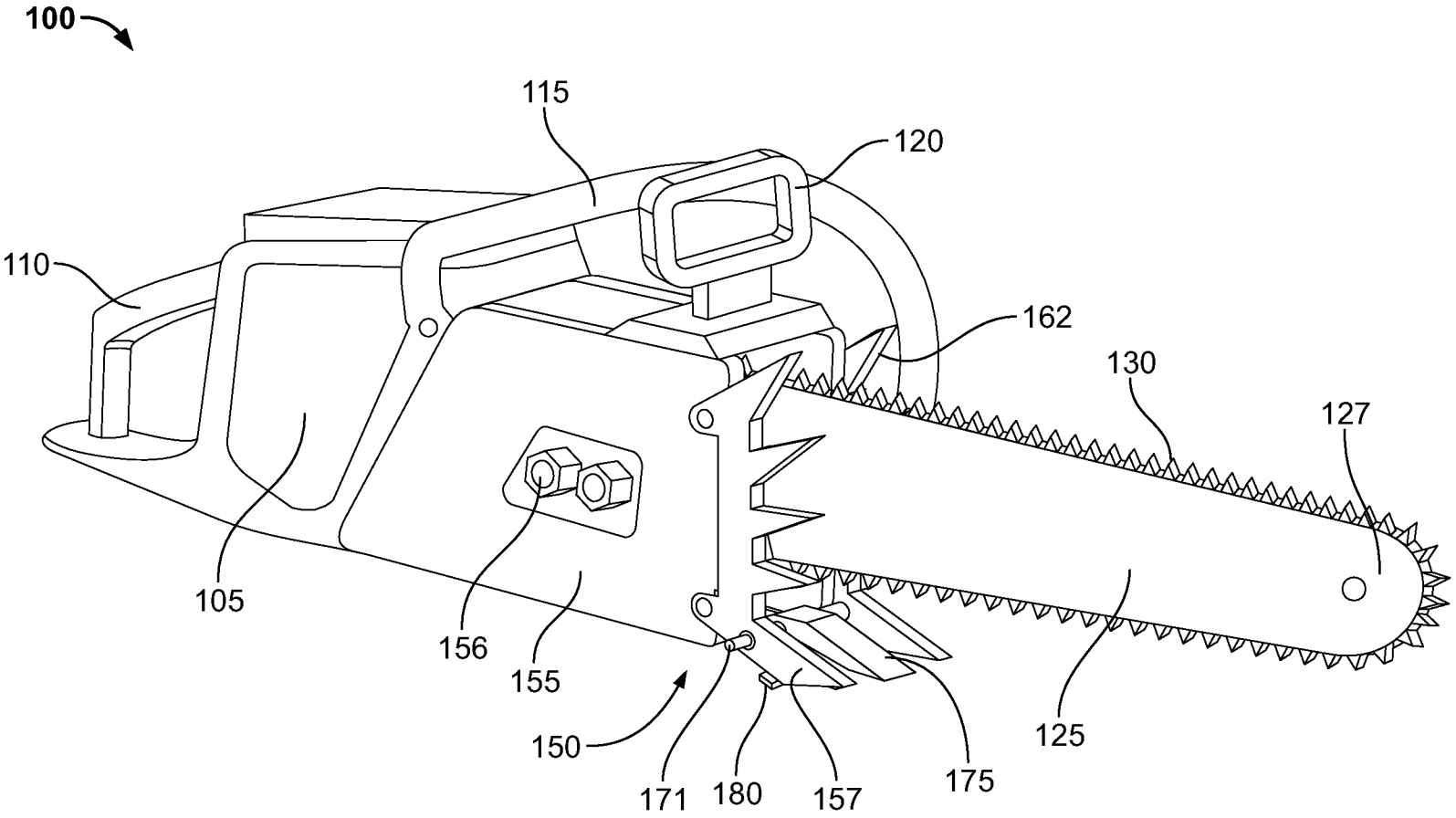
FIG. 1 illustrates an isometric view of a chainsaw 100, in accordance with one embodiment of the present disclosure.

Referring to FIG. 1, an isometric view of a hand held cutting device such as a chainsaw 100 is shown, in accordance with one embodiment of the present disclosure. The chainsaw 100 comprises a housing or main body 105. The housing 105 may be made up of hard plastic or metal, for example. The chainsaw 100 comprises a rear hand guard 110, a front handle 115, and a front hand guard 120. The rear hand guard 110, the front handle 115 and the front hand guard 120 may be made up of hard plastic, metal or any other suitable material.

It should be understood that a user of the chainsaw 100 might operate the chainsaw 100 by holding the rear hand guard 110 with one hand and either one of the front handle 115 or the front hand guard 120 with the other hand.

Further, the chainsaw 100 comprises a guide bar 125 made up of metal or any other suitable material. The guide bar 125 may comprises a nose 127 provided at a far end of the guide bar 125. Further, the guide bar 125 may be provided with a saw chain 130 comprising a plurality of teeth. As can be seen, the saw chain 130 is provided around the guide bar 125. As known, the saw chain 130 may be used to cut materials such as wood, logs, tree, and so on.

Within the housing 105, the chainsaw 100 may comprise an electric drive motor, a gear unit downstream of the drive motor, and a motion converter as known in the art of electric motors. The saw chain 130 is coupled to the gear unit. It should be understood that the motor may be operated using one of gasoline engine, electric motor, batteries or wired connections. When the motor is operated, the motor engages the motion converter to convert rotary motion of the motor rotation motion of the gear unit, which in turn drives the saw chain 130 around the guide bar 125.

Figure 2:
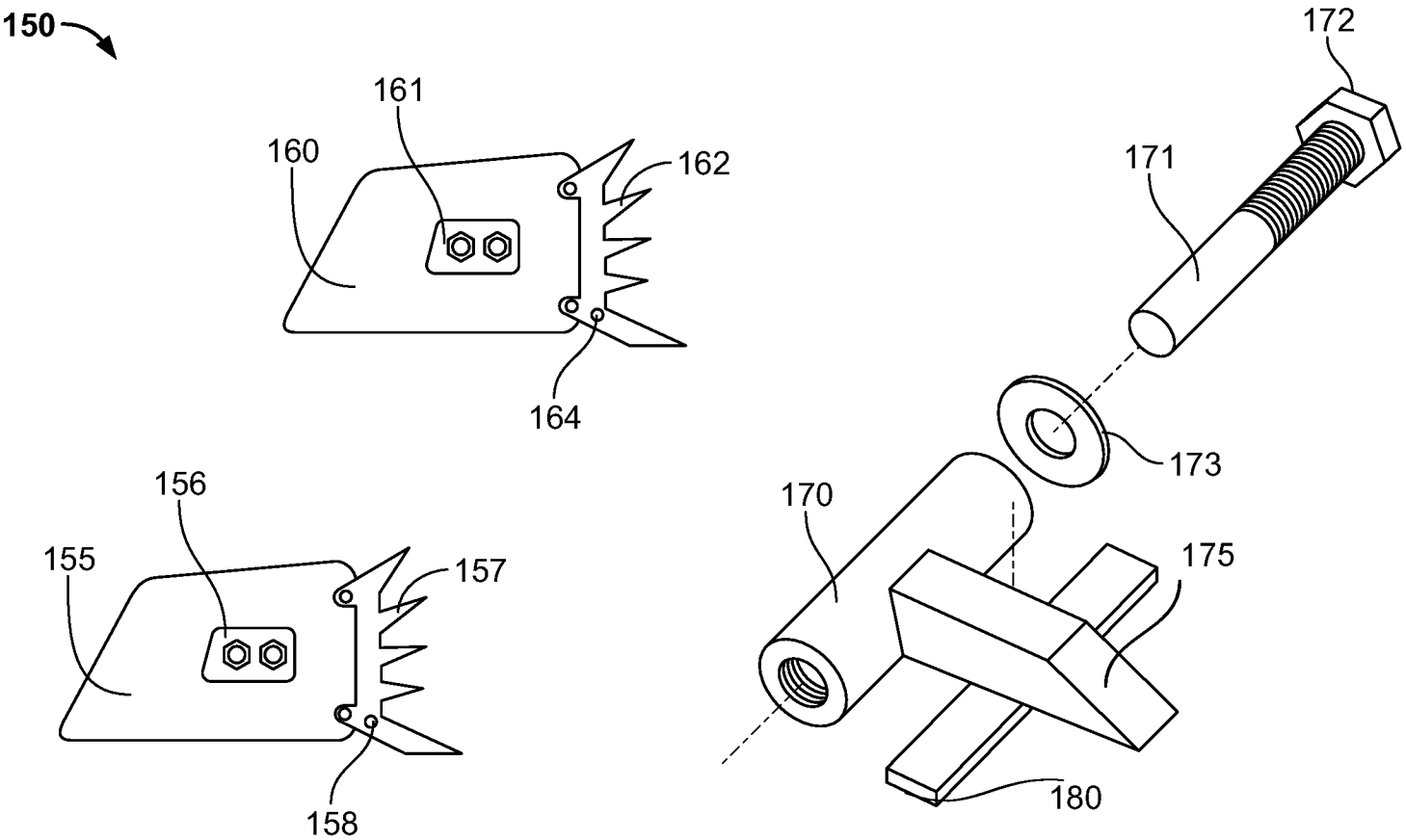
FIG. 2 illustrates an exploded view a spike attachment 150, respectively, in accordance with one embodiment of the present disclosure.

In accordance with one implementation of the present disclosure, the chainsaw 100 comprises a spike attachment 150. Now referring to FIGS. 2 and 3, an exploded view and a isometric view of the spike attachment 150 is shown, respectively. The spike attachment 150 comprises a first casing 155 coupled to the housing 105 using one or more fasteners 156. The first casing 155 may indicate a plate made up of metal. Further, the first casing 155 comprises a plurality of tooth portions or first spikes 157. The plurality of first spikes 157 may be provided as an integral part of the first casing 155 or might be coupled to the housing 105 using fasteners such as one or more fasteners 156. As can be seen in FIG. 2, at the bottom of the plurality of first spikes 157, the first casing 155 is provided with a first opening 158.

Further, the spike attachment 150 comprises a second casing 160 coupled to the housing 105 using one or more fasteners 161. The second casing 160 may indicate a plate made up of metal. Further, the second casing 160 comprises a plurality of tooth portions or second spikes 162. The plurality of second spikes 162 may be provided as an integral part of the second casing 160 or might be coupled to the housing 105 using fasteners such as one or more fasteners 161. As can be seen in FIG. 2, at the bottom of the plurality of second spikes 162, the second casing 160 is provided with a second opening 164.

Figure 5:
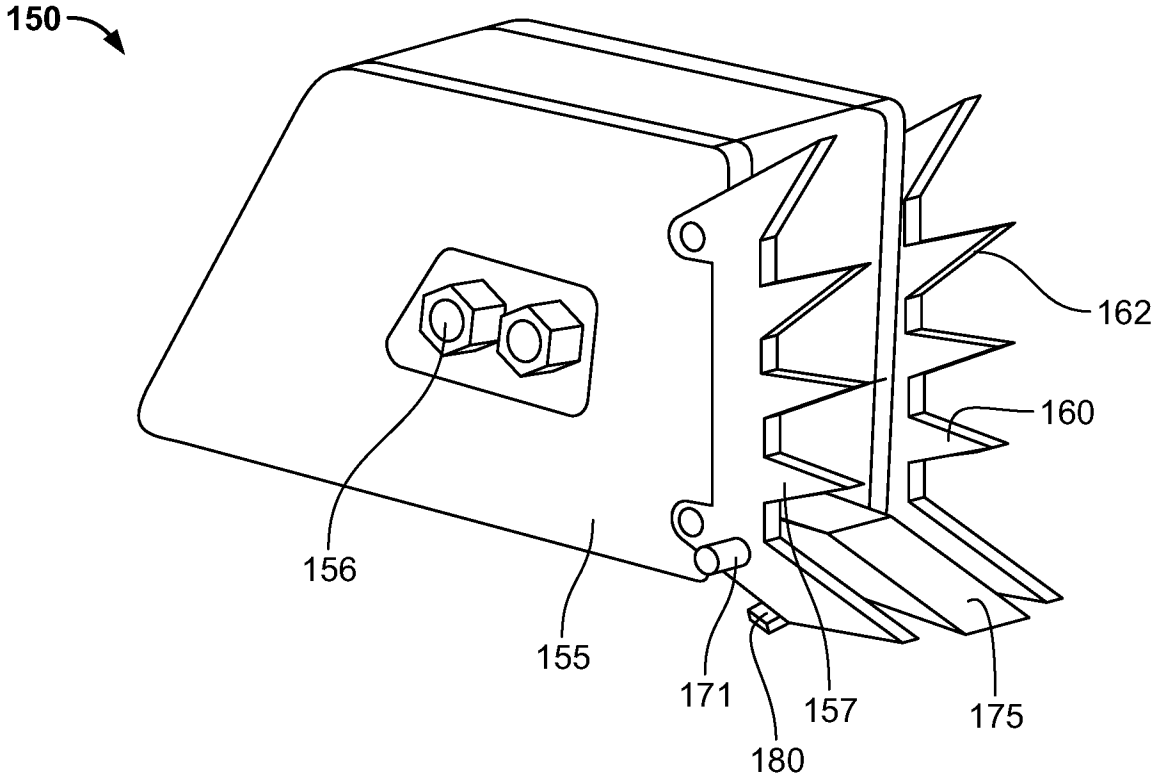
FIG. 5 illustrates an isometric view of the spike attachment 150, in accordance with one embodiment of the present disclosure.

Further, the spike attachment 150 comprises a rod 170 having internal threading. Further, the spike attachment 150 comprises a fastener 171 with a head 172. As can be seen, the fastener 171 comprises a threading portion up to 50% of its length and remaining portion is provided as smooth bore. Further, the rod 170 comprises a lock washer 173. Further, the rod 170 is provided with a scraper 175. The scraper 175 is made up of metal. As can be seen in FIG. 2, the scraper 175 is provided in an angle i.e., pointedly facing outward in the direction of the spikes provided at the first casing 155 and the second casing 160. As can seen in FIG. 1, length of the scraper 175 is more than the length of the bottom spike of the plurality of first spikes 157 and the bottom spike of the plurality of second spikes 162 which are provided at a bottom of the first casing 155 and the second casing 160, respectively. However, the scraper 175 will have slightly more length than a bottom spike of the plurality of first spikes 157 and of the plurality of second spikes 162 provided at the bottom. The scraper 175 and a bottom spike of plurality of first spikes 157 and the plurality of second spikes 162 each have the same angle. As depicted in FIGS. 1 and 5 the angle is a downward angle. Further, the spike attachment 150 comprises a base plate 180 used to engage the scraper 175 to the first casing 155 and the second casing 160 at the bottom of the spikes 157, 162.

Figure 3:
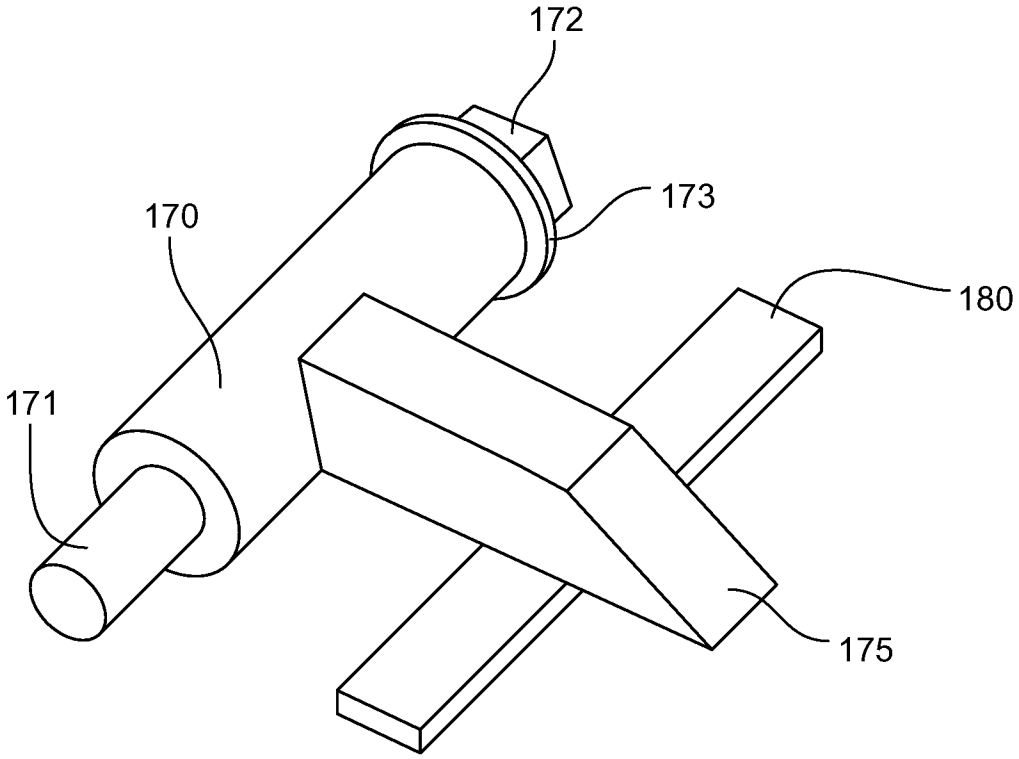
FIG. 3 illustrates a scraper 175, in accordance with one embodiment of the present disclosure.
Figure 4:
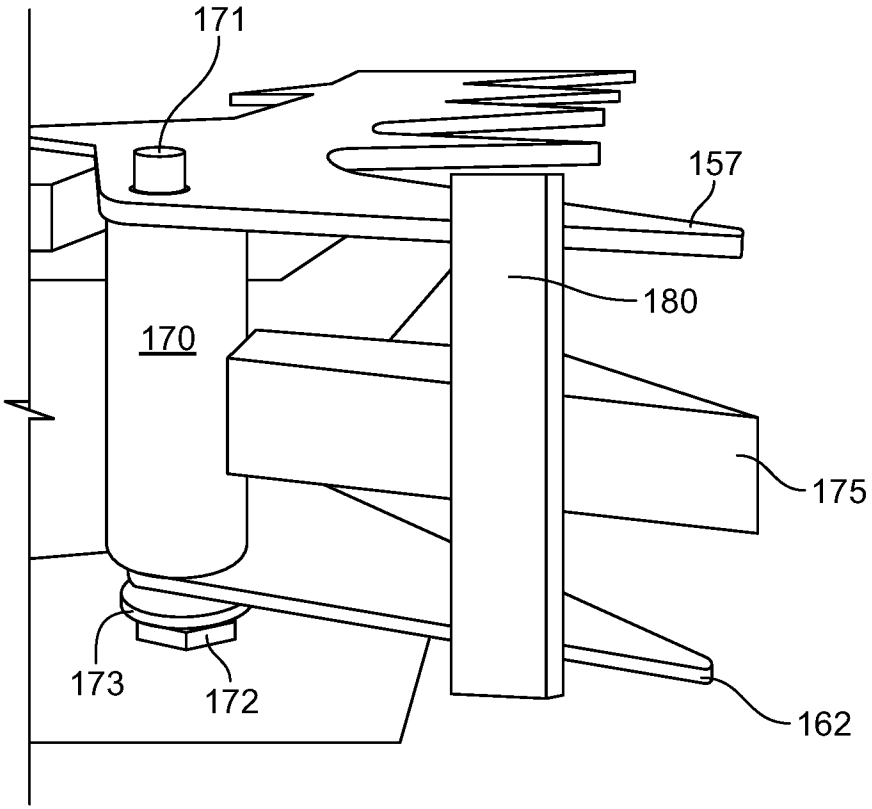
FIG. 4 illustrates a bottom view of the scraper 175 coupled to the spikes 157 and 162, in accordance with one embodiment of the present disclosure.

Referring to FIG. 3, a perspective view of the scraper 175 coupled to the rod 170 and the fastener 171 coupled to the rod 170 is shown. As can be seen, the scraper 175 is coupled to the rod 170 using known mechanism such as welding. Further, the base plate 180 is coupled to the scraper 175 using known mechanism such as welding. The fastener 171 can be drawn through the lock washer 173 and inserted in the rod 170. Now, referring to FIG. 4, a bottom perspective view of the spike attachment 150 in which the scraper 175 is coupled to the plurality of first spikes 157 and the plurality of second spikes 162 is shown. The scraper 175 is coupled to the plurality of first spikes 157 and plurality of second spikes 162 through rod 170. In order to couple the scraper 175 to the plurality of first spikes 157 and the plurality of second spikes 162, at first the fastener 171 is drawn through the lock washer 173. Subsequently, the fastener 171 is drawn through the second opening 164 in the second casing 160. Further, the fastener 171 is drawn through the rod 170 and further made to enter in the first opening 158 in the first casing 155.

Referring to FIG. 5, a perspective view of the spike attachment 150 the scraper 175 is coupled to the plurality of first spikes 157 and the plurality of second spikes 162 is shown. Now referring to FIGS. 1 and 5, it should be understood that the scraper 175 might be positioned or aligned in axis with the saw chain 130. In other words, the scraper 175 is positioned in the line of axis of i.e., below the saw chain 130.

Figure 6:
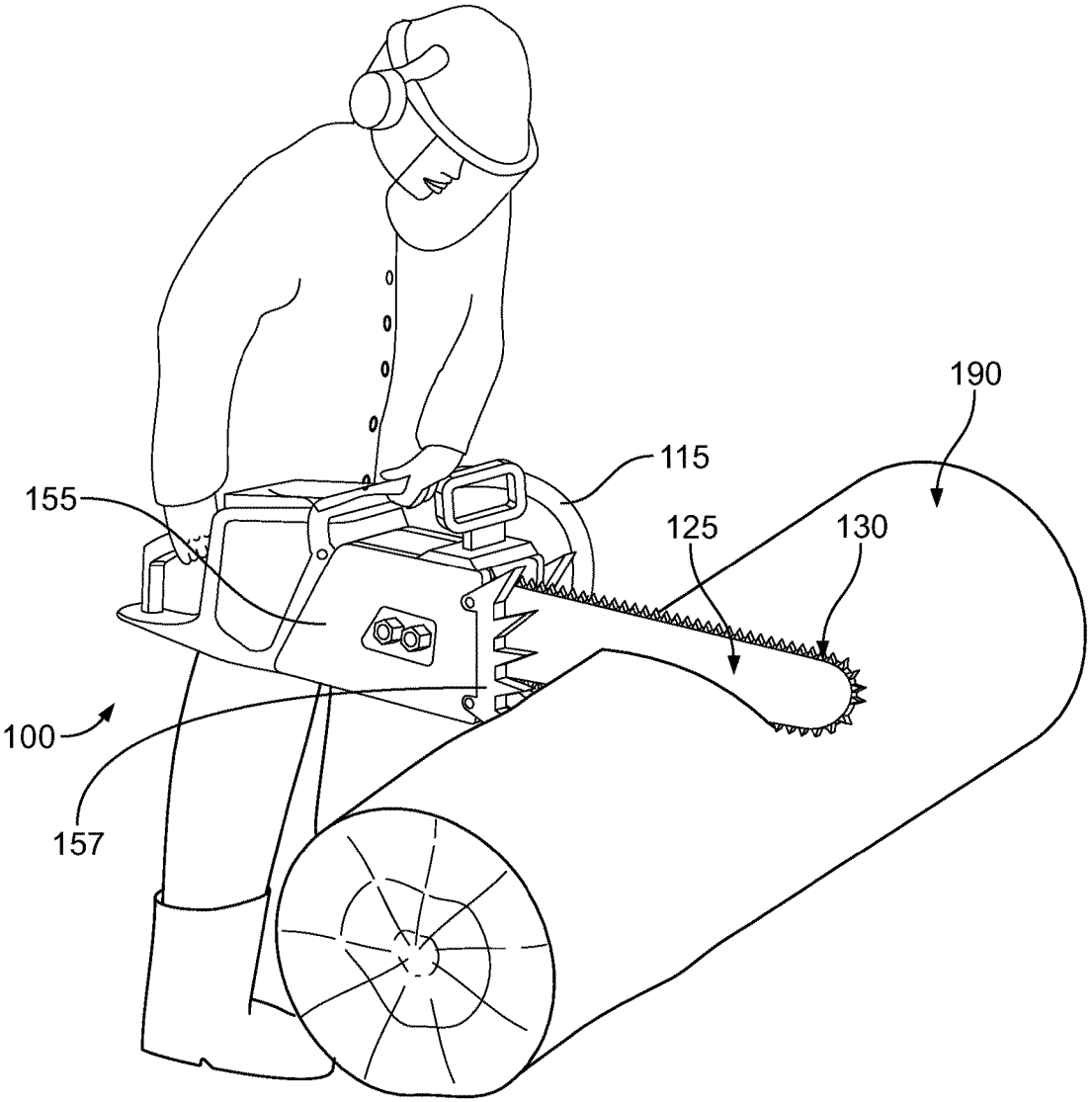
FIG. 6 illustrates the chainsaw 100 used for cutting wood 190 without damaging a saw chain, in accordance with one embodiment of the present disclosure.

Now referring to FIG. 6, operation of the chainsaw 100 to clear dirt off wood is explained. As known, the chainsaw 100 is used to cut timber or wood or logs 190. It is known that the wood 190 may comprise bark, in which rocks, dirt or mud may get crammed. Due to the placement of the scraper 175 below the saw chain 130, when the user tries to cut the wood 190, initially the scraper 175 comes in contact with bark on the wood 190. This is because the scraper 175 has more length than the first spike of the plurality of first spikes 157 and of the plurality of second spike 162 provided at the bottom of the first casing 155 and the second casing 160, respectively. As such, the scraper 175 comes in contact with the wood 190 first. Subsequently, the user may apply pressure on the bark on the wood 190 via the scraper 175 such that the scraper 175 may scrape or clean or debark the dirt or bark on the wood 190 thereby removing or clearing the dirt or bark in line of axis of the saw chain 130. As specified above, the scraper 175 is positioned or aligned in axis with the saw chain 130. As such, the scraper 175 removes the dirt on the wood 190 so that the saw chain 130 can cut the wood 190 without damaging the teeth of the saw chain 130. In other words, the scraper 175 cleans or debarks the wood 190 before the saw chain 130 makes a cut in order to prevent debris or dirt that is lodged in the bark from contacting and possibly damaging the saw chain 130.

Further, the plurality of first spikes 157 and the plurality of second spikes 162 are provided on the first casing 155 and the second casing 160, respectively may also help in removing the dirt or bark in order to prevent debris or dirt that is lodged in the bark from contacting and possibly damaging the saw chain 130.

Based on the above, it should be understood that the spike attachment comprising the scraper could be used to clear the bark in order to provide a clean cutting surface for the saw chain. As such, the teeth of the saw chain can be protected against wear and tear from the debris or dirt embedded in the bark of the wood.

Further, it should be understood that the scraper provides a clean, and clear wood surface for penetration by the saw chain, which helps to extend life of the saw chain. As such, the scraper helps to reduce or avoid sharpening the teeth of the saw chain. Thus, the chainsaw comprising the scraper in line of axis of the saw chain saves time and energy required to sharpening the saw chain. Further, the scraper extends the life of the saw chain and eliminates or reduces the need for replacement of saw chain frequently.

It should be understood that the drawings are provided for illustrative purpose only and a person skilled in the art will understand that it is obvious to provide the spike attachment i.e., the casing with spike and the scraper in different shapes and sizes to clear mud or dirt on the bark or wood before the saw chain makes the cut.

Although the present disclosure is explained considering that the chainsaw is provided with a scraper to remove dirt or debark the wood before making the cut, it should be understood that the scraper might also be provided for other cutting devices including handheld cutting devices to remove dirt in order to protect the saw chain or saw blade.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A chainsaw, comprising:

a) a housing;

b) a spike attachment including a first casing and a second casing each having four perimeter sides, wherein said first casing and said second casing is coupled to said housing, wherein one of said four perimeter sides of each of said casings includes a plurality of spikes extending therefrom, a last one of said plurality of spikes of said first casing and a last one of said plurality of spikes of said second casing each having a circular opening thereon;

c) a rod having internal threading, a first open end, and a second open end, wherein said rod is mounted between said plurality of spikes of said first casing and said plurality of spikes of said second casing so that said circular openings are aligned with said open ends, a fastener inserted through said circular opening of said first casing and said first open end into said internal threading and protrudes out said second open end and said circular opening of said second casing;

d) a scraper welded onto an outer surface of said rod, wherein said scraper is an inclined wedge extending from said rod, said scraper positioned between said plurality of spikes of said first casing and said second casing; and e) a base plate connected to said scraper, to said last one of said plurality of spikes of said first casing, and to said last one of said plurality of spikes of said second casing.

2. The chainsaw of claim 1 wherein said first casing and said second casing include a center portion which includes fasteners to be coupled to said housing.

3. The chainsaw of claim 1 wherein each of said plurality of spikes are respectively removably coupled to said first casing and to said second casing.

4. The chainsaw of claim 1 wherein said last spikes are elongated having a length greater than lengths of remaining ones of said plurality of spikes.

5. The chainsaw of claim 4 wherein said scraper includes a length being greater than said length of said elongated spike.

6. The chainsaw of claim 1 wherein said housing includes a front hand guard, a rear hand guard and a front handle.

7. The chainsaw of claim 1 wherein a lock washer is mounted between said fastener and said rod.

8. The chainsaw of claim 1 wherein said fastener includes an outer surface having a threading portion extending half a length of said fastener.

9. The chainsaw of claim 8 wherein said outer surface of said fastener includes a smooth portion extending half of said length of said fastener.

10. The chainsaw of claim 1 wherein said base plate is a rectangular member.

11. A chainsaw, comprising:

a) a housing being made of a plastic or metal material, a rear hand guard located at a back end of said housing, a front hand guard located a front end of said housing, wherein said front hand guard is a rectangular member with an opening, said housing further including a front handle, a guide bar extending from said front end of said housing, said guide bar including a nose at a distal end, wherein said guide bar is further includes a saw chain having a plurality of teeth which is located around the perimeter of said guide bar, said housing including an electric drive motor in communication with said saw chain and said guide bar to provide a rotating motion;

b) a spike attachment including a first casing and a second casing each having a rectangular shape with four perimeter sides, said first casing and said second casing having a center portion which include fasteners which couple said housing, wherein one of said four perimeter sides of said first casing includes a first spike portion, wherein one of said four perimeter sides of said second casing includes a second spike portion, wherein said first spike portion and said second spike portion includes a plurality of spikes extending from a side, wherein said first spike portion and said second spike portion each includes a first spike and a last spike, said last spike of said first spike portion and said second spike portion being an elongated spike having a length greater than a length of said plurality of spikes, wherein said first spike portion is removably coupled from said first casing, wherein said second spike portion is removable coupled from said second casing, wherein said last spike of said first spike portion includes a first opening, wherein said last spike of said second spike portion includes a second opening;

c) a rod having a cylindrical shape with an interior surface having internal threading, said rod having a first end and a second end each with a circular opening;

d) a fastener having a head mounted thereon, wherein said fastener is a cylindrical member with an outer surface, wherein said outer surface includes a threading portion extending half of a length of said fastener from said head, wherein said fastener includes a smooth portion extending half of said length of said fastener from said threading portion, a lock washer placed between said fastener and said rod;

e) a scraper made of a metal material extending from said rod, said scraper being a wedge member, wherein said scraper is provided at an angle pointedly facing outward in a direction corresponding to a direction of said plurality of spikes, wherein said scraper includes a length being greater than a length of said elongated spike of said first spike portion and said second portion, wherein said rod is mounted between said first casing and said second casing, said circular openings of said rod aligning with said first opening of said first casing and said second opening of said second casing, said fastener inserted through said first opening into said circular opening of said first end and protrudes out said circular opening of said second end and said second opening so that said internal threading engages said threading portion of said outer surface; and f) a base plate connected to said scraper, to said last one of said plurality of spikes of said first casing, and to said last one of said plurality of spikes of said second casing.

* * * * *